US011849858B1

(12) United States Patent
Hsu Besner et al.

(10) Patent No.: US 11,849,858 B1
(45) Date of Patent: Dec. 26, 2023

(54) PILLOW

(71) Applicant: Sunflow, Inc., Delray Beach, FL (US)

(72) Inventors: Leslie Hsu Besner, Short Hills, NJ (US); Jeffrey Servaites, Oakland, CA (US)

(73) Assignee: Sunflow, Inc., Delray Beach, FL (US)

( * ) Notice: Subject to any disclaimer, the term of this patent is extended or adjusted under 35 U.S.C. 154(b) by 0 days.

(21) Appl. No.: 17/830,749

(22) Filed: Jun. 2, 2022

(51) Int. Cl.
*A47C 7/02* (2006.01)
*A47G 9/10* (2006.01)
*A47C 7/38* (2006.01)

(52) U.S. Cl.
CPC ..... *A47C 7/0213* (2018.08); *A47C 7/383* (2013.01); *A47G 9/10* (2013.01)

(58) Field of Classification Search
USPC ..... 297/399, 400, 401
See application file for complete search history.

(56) References Cited

U.S. PATENT DOCUMENTS 357,305 A * 2/1887 Bonnell ..... B60N 2/882 297/401
368,323 A * 8/1887 Cornelius ..... B60N 2/882 297/401
371,817 A * 10/1887 Brown ..... B60N 2/882 297/401
380,251 A * 3/1888 Dillon ..... B60N 2/882 297/401
485,374 A * 11/1892 Durkee ..... B60N 2/882 297/399
490,865 A * 1/1893 Dreisbach ..... B60N 2/882 5/643
506,983 A * 10/1893 Diemmer ..... B60N 2/882 297/401
673,617 A * 5/1901 Deaner ..... B60N 2/882 297/399
2,566,757 A * 9/1951 Alexander ..... B60N 2/882 297/401
2,623,575 A * 12/1952 Challis ..... A47C 7/383 297/401
3,328,082 A * 6/1967 Lilleso ..... B60N 2/844 297/399
4,498,704 A * 2/1985 Hildreth ..... A61G 5/121 297/400
5,611,123 A * 3/1997 Prizzi ..... A47C 7/62 297/229

(Continued)

OTHER PUBLICATIONS

International Search Report and Written Opinion for International Application No. PCT/US2023/023947, dated Sep. 19, 2023.

*Primary Examiner* — David E Allred
(74) *Attorney, Agent, or Firm* — Wolf, Greenfield & Sacks, P.C.

(57) ABSTRACT

A pillow assembly for a chair is disclosed. The pillow assembly includes a pillow and clip assembly. The clip assembly is attached to the back of the pillow and is biased toward the back of the pillow such that a restorative force may secure the pillow to a chair. A grippy part may be disposed on the clip assembly to enhance securing the pillow in a desired position. The attached clip part may also have a protruding tab for a user to easily grasp the clip assembly. The clip assembly can slide over a complementary part on a chair, and is biased to secure the pillow in a desired position.

10 Claims, 12 Drawing Sheets

(56) References Cited

U.S. PATENT DOCUMENTS

| | | | | |
|---|---|---|---|---|
| 5,800,019 | A | 9/1998 | Knightlinger | |
| 8,033,603 | B2 * | 10/2011 | Meert | B60N 2/80 297/216.12 |
| 8,573,701 | B2 * | 11/2013 | Yetukuri | B60N 2/865 297/216.12 |
| 8,668,270 | B2 * | 3/2014 | Ciepiela | A45D 44/10 297/399 |
| 9,816,540 | B2 * | 11/2017 | Smullen | D06F 55/00 |
| 2002/0067063 | A1 | 6/2002 | Taborro | |
| 2005/0121962 | A1 * | 6/2005 | Gold | A47D 15/006 297/399 |
| 2021/0127838 | A1 | 5/2021 | Gu et al. | |

* cited by examiner

PILLOW

FIELD

Disclosed embodiments are related to a pillow configured to clip to a chair.

BACKGROUND

Chair comfort and support can improve user experience. Though measures have been taken to include a pillow on a chair, further improvements can be made.

SUMMARY

In one embodiment, a pillow assembly is provided. The pillow assembly includes a pillow and a clip assembly coupled to the pillow. The clip assembly includes a body that is biased toward the pillow such that a restorative force may secure the pillow to a chair.

In another embodiment, a pillow assembly is provided. The pillow assembly includes a pillow and a clip assembly coupled to the pillow. The clip assembly includes a U-shaped body that is biased toward the pillow such that a restorative force may secure the pillow to a chair. The U-shaped body includes an outwardly formed bend. A grippy part is disposed on a lower end of the U-shaped body. A tab protrudes from the lower end of the U-shaped body.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various nonlimiting embodiments when considered in conjunction with the accompanying figures.

BRIEF DESCRIPTION OF DRAWINGS

In the drawings, each identical or nearly identical component that is illustrated in various figures is represented by a like reference character. For purposes of clarity, not every component may be labeled in every drawing. The drawings are not necessarily drawn to scale, with emphasis instead being placed on illustrating various aspects of the techniques and devices described herein. In the drawings.

DETAILED DESCRIPTION

The inventors have recognized the benefits of a pillow that can be easily attached to a chair to improve user experience during use of the chair. The pillow may be effective at providing support and comfort to a user while remaining in a desired position relative to the chair. The pillow may be integrated with a clip assembly. The clip assembly may include a part that is attached to the back of the pillow. When the clip assembly is slid over a complementary part on a chair, the pillow remains in place for secure use by a user.

The inventors have found that the clip assembly may be configured such that the pillow remains in a desired position when in use and is easily mounted on a chair. In this regard, a restorative force caused by the clip assembly will tend to secure the pillow to the chair at the desired location. To accomplish this, the clip assembly is constructed with a biased clip part. A grippy material may be disposed on the clip part to enhance securing the pillow in the desired position.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

Figure 1:
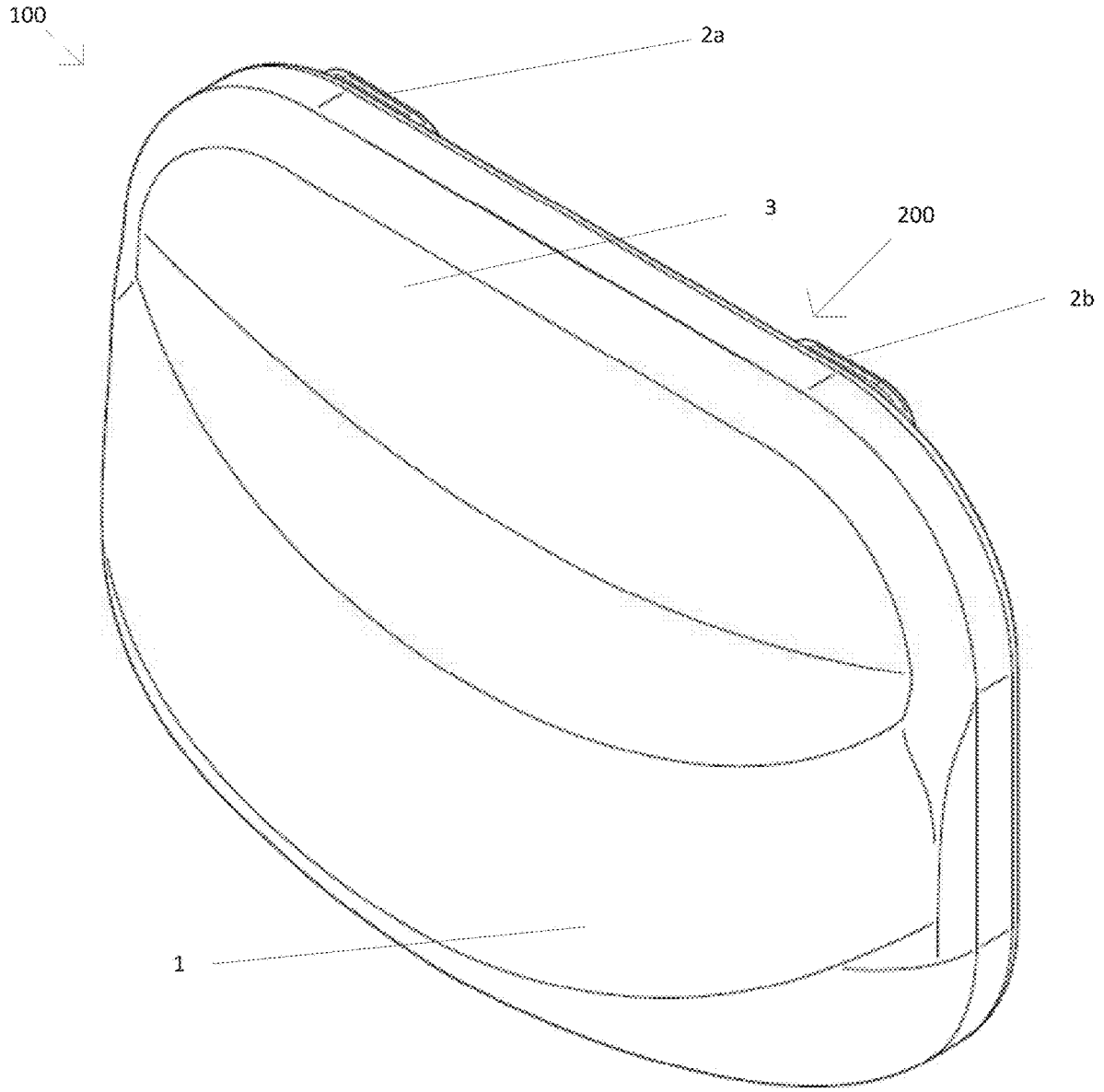
FIG. 1 is a front perspective view of an example of a pillow and clip assembly, according to some embodiments.
Figure 2:
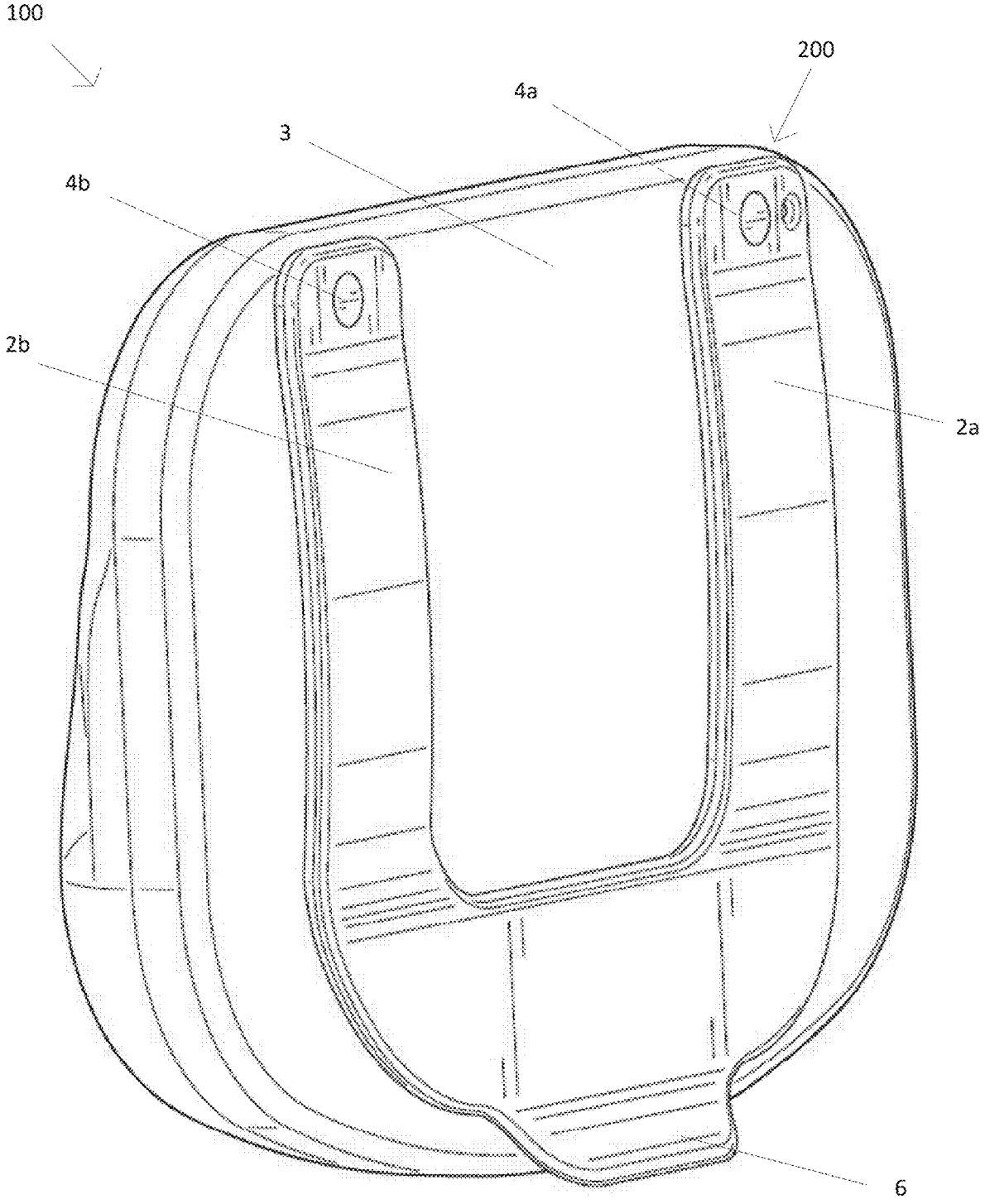
FIG. 2 shows a rear perspective view of the pillow and clip assembly of FIG. 1.

FIGS. 1 and 2 illustrate a pillow assembly 100 for a chair. The pillow assembly 100 includes a pillow 3 and a clip assembly 200. The clip assembly allows the user to position the pillow assembly on a chair, such as a beach chair (e.g., chair 10 in FIG. 14), in any desired up/down position along the back of the chair.

The clip assembly 200 is biased to apply a force against the back of the pillow 3 in a manner so as to squeeze the fabric of the chair between the clip assembly 200 and the back of the pillow 3.

Figure 3:
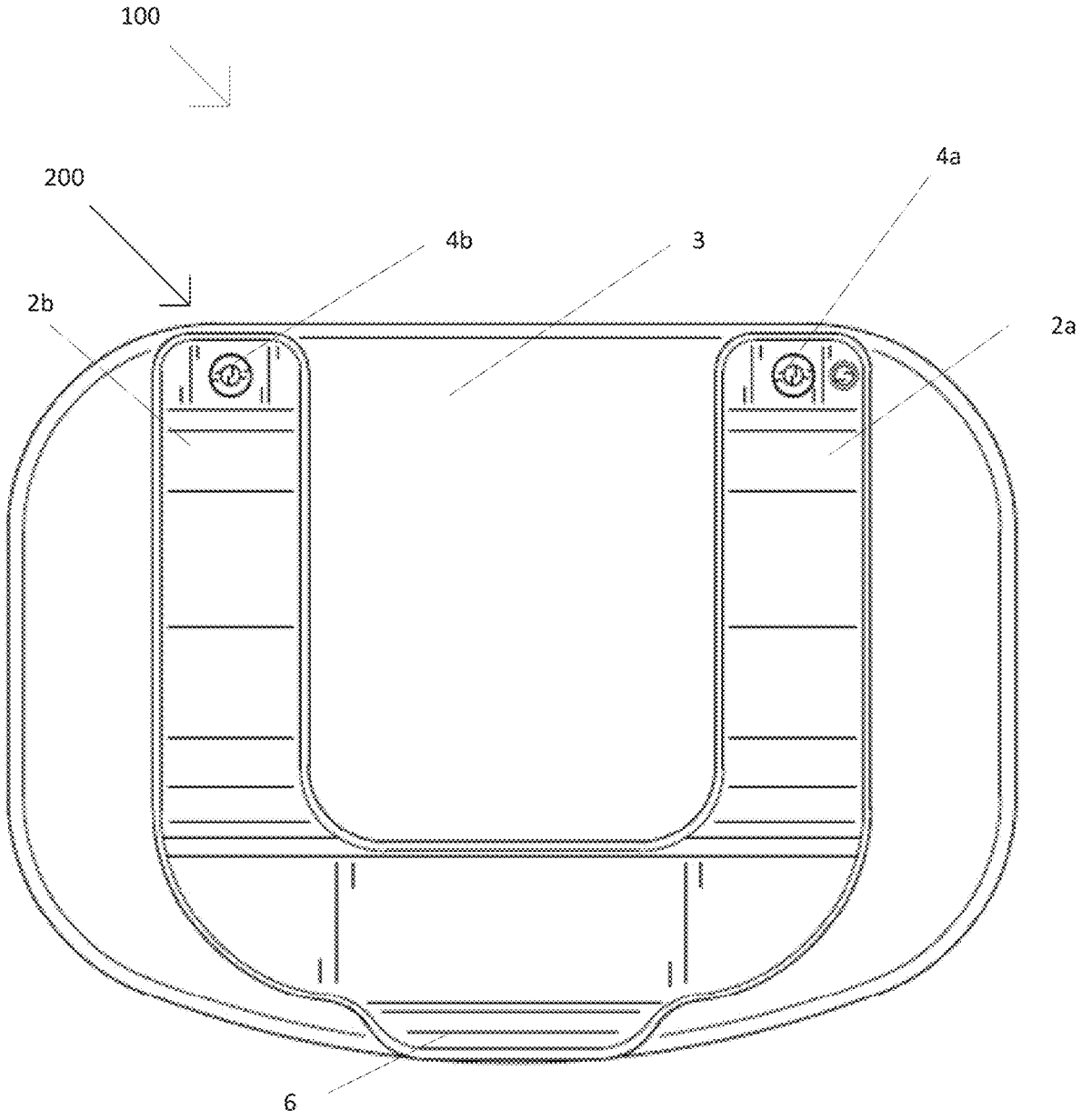
FIG. 3 is a rear view of the pillow and clip assembly of FIG. 1.
Figure 10:
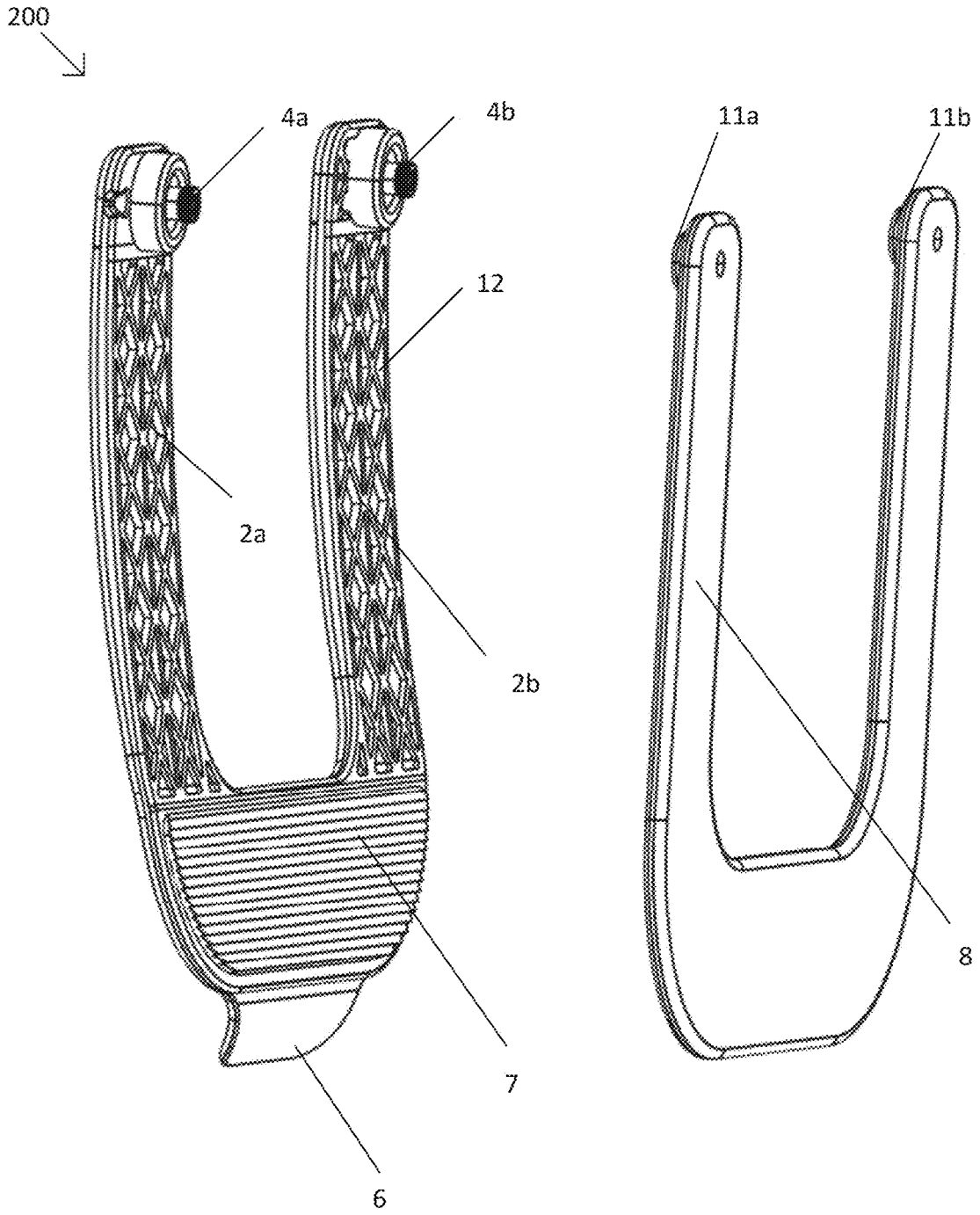
FIG. 10 shows an exploded view of the clip assembly of FIG. 9.
Figure 11:
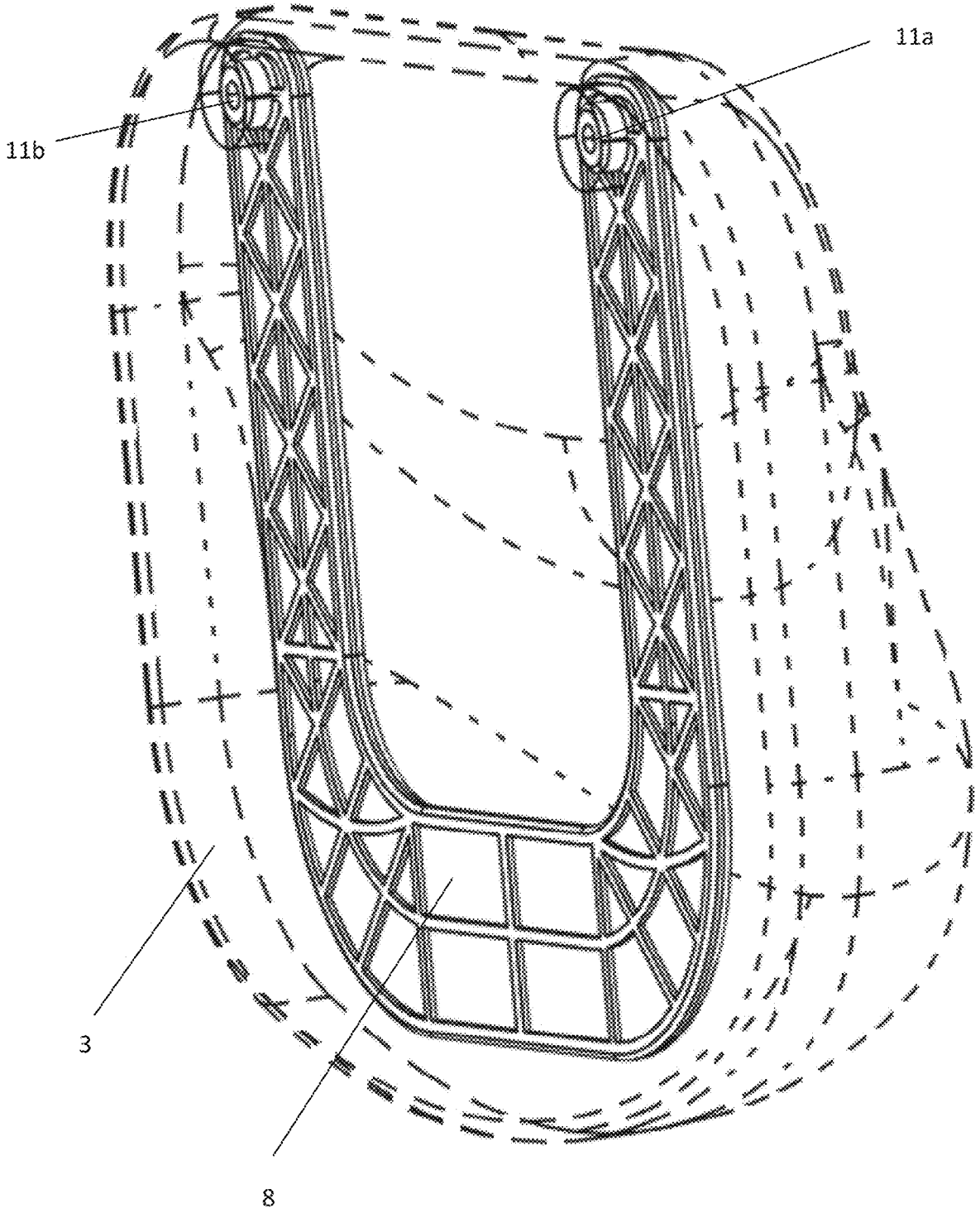
FIG. 11 shows an internal part of the clip assembly of FIG. 9, with the pillow shown in dashed and the internal part disposed in the pillow.

Turning to FIG. 3, a rear view of the pillow 3 and clip assembly 200 of FIG. 1 is shown. In the embodiment shown, the clip assembly 200 includes side arms 2*a* and 2*b*. When a chair user clips the pillow assembly 100, side arms 2*a*, 2*b* may provide stability for the pillow assembly 100. In this regard, without wishing to be bound by theory, the side arms provide a degree of lateral dimension to the clip assembly such that the pillow assembly may remain in a plane relative to the fabric of the chair. That is, the pillow can remain in position without twisting or moving on one lateral side or the other. In one embodiment, as will be apparent below, the clip assembly 200 includes screws or screw fasteners 4*a*, 4*b* to allow the side arms 2*a*, 2*b* of clip assembly 200 to be attached to the pillow 3, namely to the internal part (bracket 8, as shown in FIGS. 10 and 11) of the clip assembly that is disposed inside the pillow.

Figure 4:
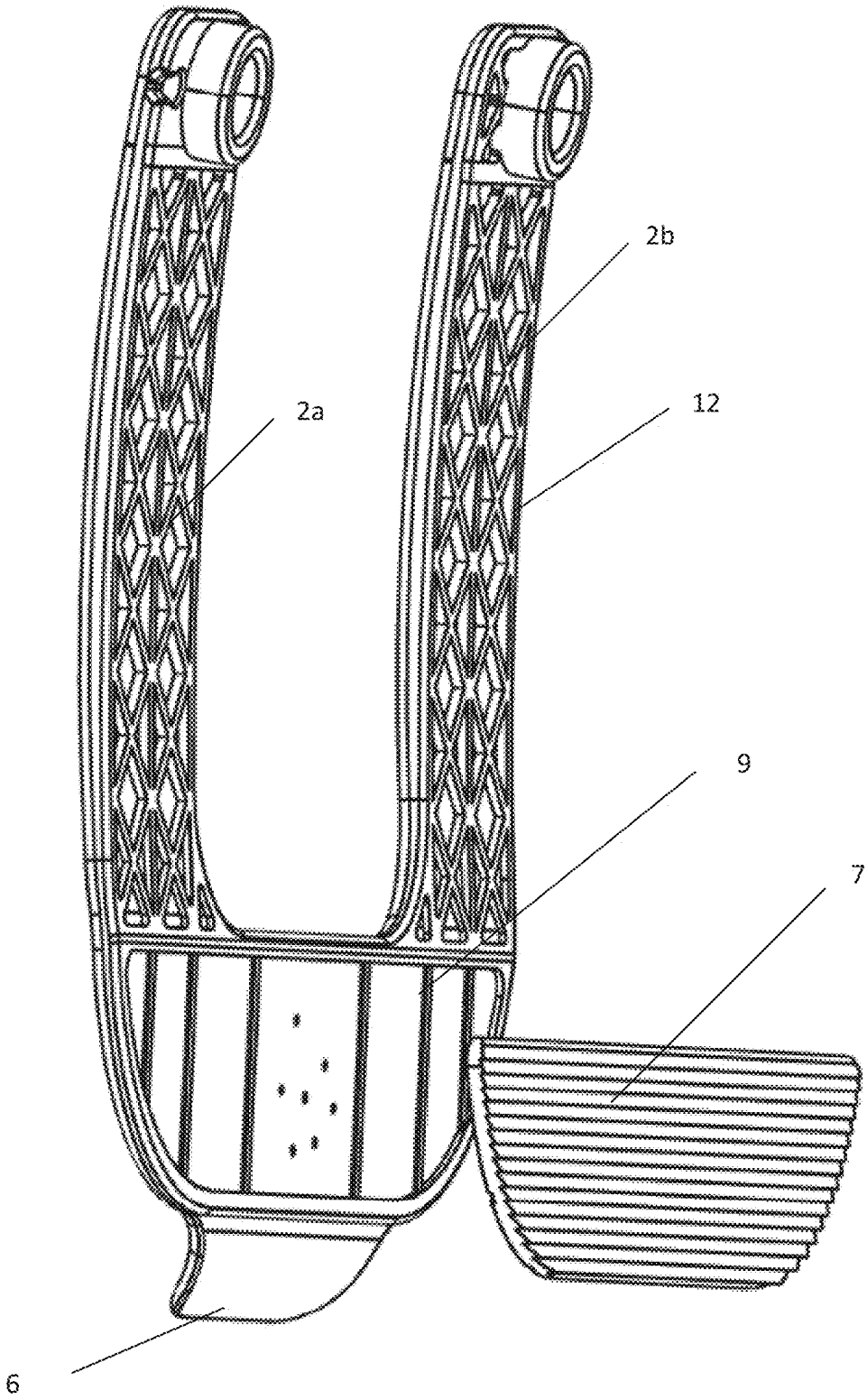
FIG. 4 shows an exploded view of part of the clip assembly of FIG. 2.

FIG. 4 shows an exploded view of part of the clip assembly 200 of FIG. 3. As shown in FIG. 4, the clip assembly includes a body portion 12 defining the two side arms 2*a* and 2*b* and generally has a U-shape. Such a U-shape not only provides the lateral stability as explained above, but a clip assembly with less material may also be formed. The lower end of the body portion 12 includes a tab 6, which protrudes therefrom. Tab 6 enables a user to easily grasp the clip assembly to bias the clip assembly away from the back of the pillow and thereby allow insertion, placement, and removal of the pillow onto the back of the chair. In one embodiment, the body portion 12 may be rigid and may be formed of plastic, thermoplastic, or any other suitable material.

In one embodiment, the tab 6 is shown to have tapered edges and rounded corners resulting in a wing-like shape; however, any suitable shape may be employed, such as a semi-circular shape. While not shown, tab 6 could include a different surface roughness or texture than the remainder of the body portion 12 such that user grip may be improved.

Continuing with FIG. 4, the lower end of the body portion 12 may also include a grippy part 7 attached to a surface 9. Grippy part 7 may allow for the pillow assembly 100 to remain in place better than if grippy part 7 were not included, though in some embodiments, grippy part 7 may be optional. In one embodiment, the shape of the grippy part 7 conforms to the shape of the surface 9, alternatively, the grippy part 7 may have a shape different than the shape of the surface 9. The grippy part 7 may also comprise more than one piece. Grippy part 7 may be formed of rubber silicone, thermoplastic elastomer, or another material that provides sufficient gripping capabilities. The grippy part 7 may be attached to the clip body via an adhesive material. The grippy part 7 may also be formed with the body portion using overmolding techniques.

To enhance the functionality of the grippy part 7, serrated lines may be included on the chair-facing surface, as shown in FIG. 4. Other types of shapes, such as dots, could be incorporated to achieve an enhanced grip.

Figure 5:
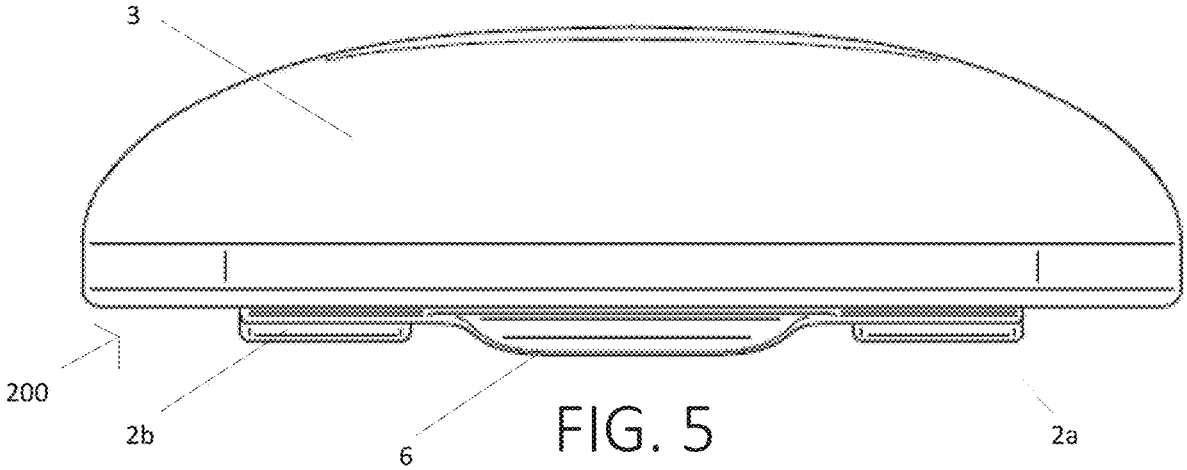
FIG. 5 is a bottom view of the pillow and clip assembly of FIG. 1.
Figure 6:
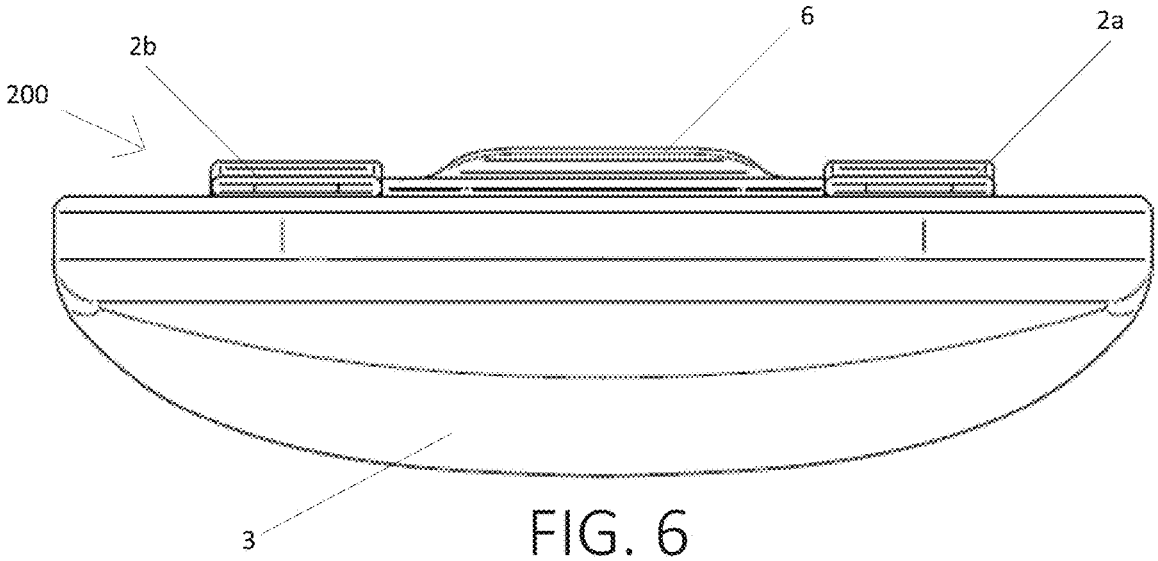
FIG. 6 is a top view of the pillow and clip assembly of FIG. 1.

FIG. 5 is a bottom view of the pillow 3 and clip assembly 200 of FIG. 1. FIG. 6 is a top view of the pillow 3 and clip assembly 200 of FIG. 1. As shown in FIGS. 5 and 6, the clip assembly lies generally in a plane parallel to the plane of the back of the pillow.

Figure 7:
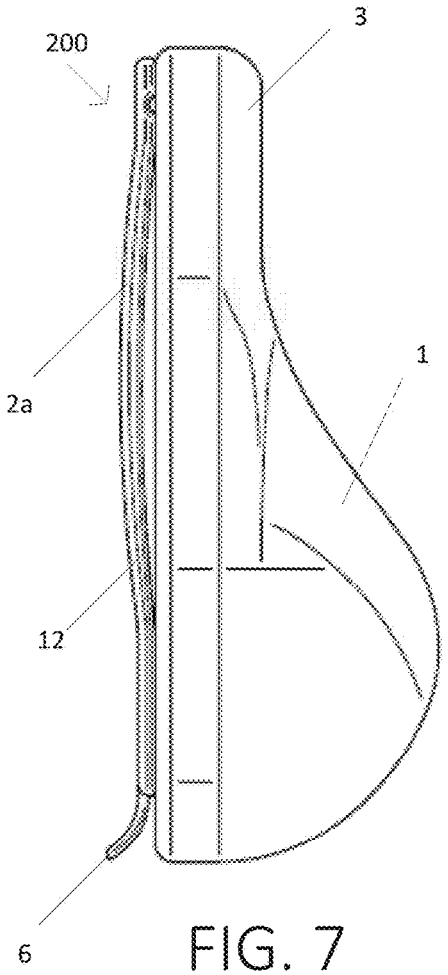
FIGS. 7 and 8 are side views of the pillow and clip assembly of FIG. 1.
Figure 8:
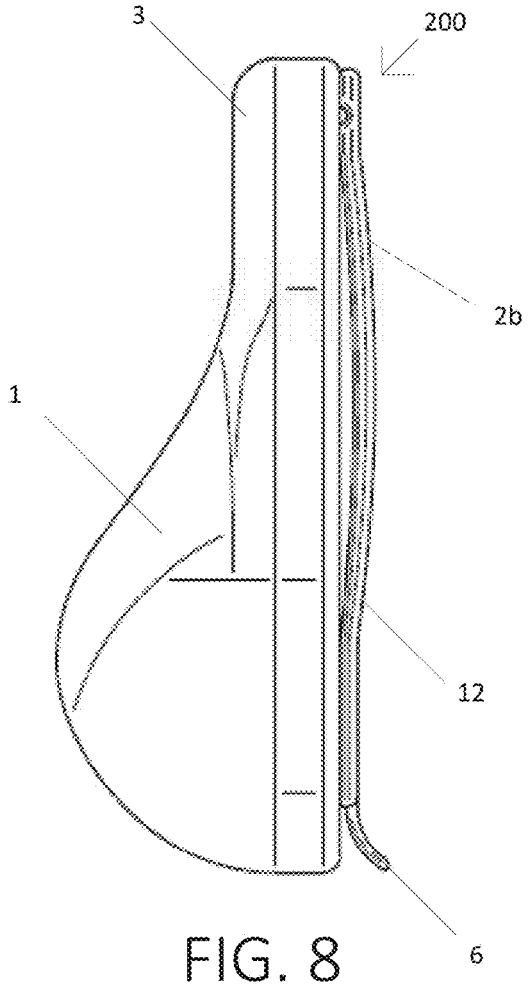

FIGS. 7 and 8 illustrate side views of the pillow 3 and clip assembly 200 of FIG. 1. As can be readily seen, side arms 2*a*, 2*b* are biased toward a rear side of pillow 3 such that no additional force is required to hold side arms 2*a*, 2*b* against the back of the pillow 3. The bias may be generated by the bent shape and compliance of the material such that a spring force is generated to keep the lower part of the clip body portion 12 against the back of the pillow 3. As illustrated in FIGS. 7-8, the body portion 12 may include an outwardly formed bend.

Figure 9:
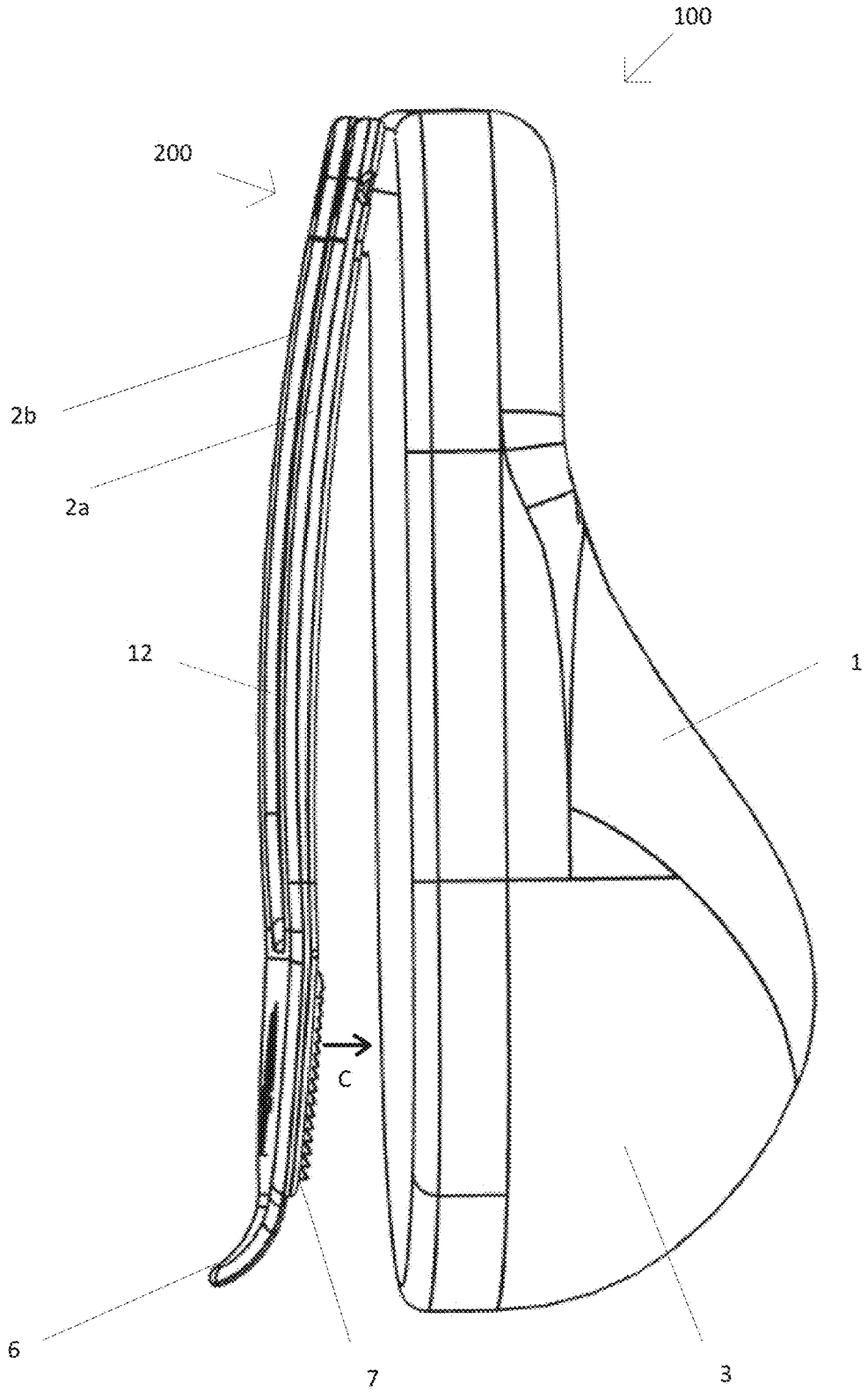
FIG. 9 shows an example of a pillow and clip assembly in which part of the clip assembly is pulled away from the back of the pillow.

FIG. 9 shows a side view of an example of a pillow 3 and clip assembly 200, with the clip assembly pulled from the back of the pillow by an external force such as by a user pulling tab 6. A restorative spring force C is illustrated such that side arms 2*a*, 2*b* cause the lower part of the body portion 12 to return to a position in which it presses against the back of the pillow (of course, with the chair fabric therebetween) without external force applied.

FIG. 10 shows an exploded view of the clip assembly 200 of FIG. 9. Clip assembly 200 includes an internal part, e.g., bracket 8, disposed inside pillow 3 of FIG. 9, when assembled. When bracket 8 is disposed in the pillow 3, the body portion 12 can be coupled to the bracket 8 by coupling screws 4*a*, 4*b* to respective mating portions 11*a*, 11*b* of bracket 8. FIG. 11 shows the bracket 8 disposed inside the pillow 3, which is illustrated with dashed lines.

Bracket 8 may also be U-shaped as illustrated in FIG. 11 or may be any suitable shape. The shape of bracket 8 may match that of the body portion 12 or it may be different.

Figure 12:
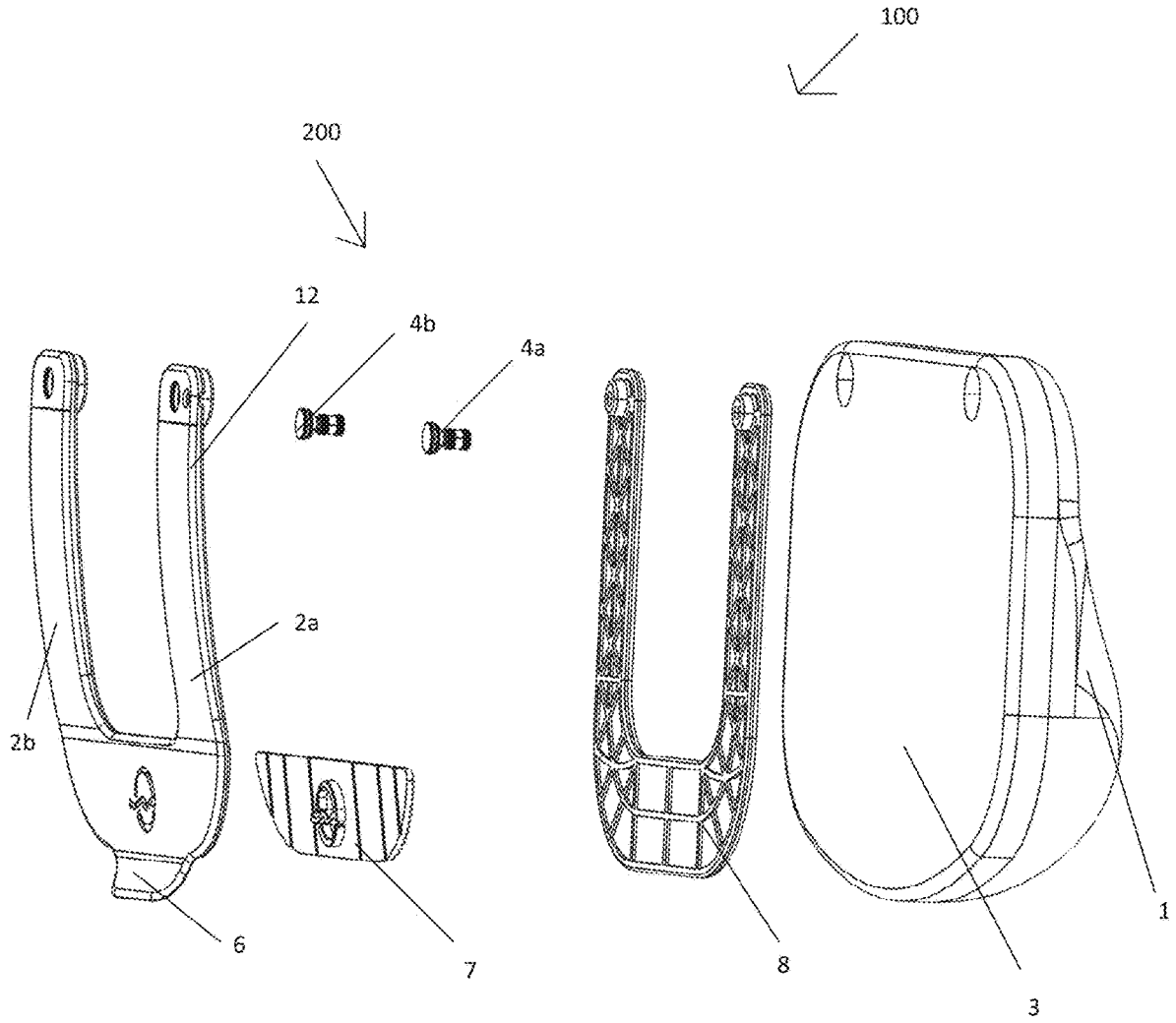
FIG. 12 shows an exploded perspective view of the pillow and clip assembly of FIG. 9.

FIG. 12 shows an exploded view of the pillow assembly 100 of FIG. 9. In this figure, the various components are shown, including the clip body portion 12, the grippy part 7, screws 4*a* and 4*b*, internal bracket 8 and pillow 3. It should be appreciated that internal bracket 8 would be disposed inside the pillow, however is shown outside of the pillow for illustrative purposes.

As shown in FIGS. 7-9 and 13, the front of pillow 3 has a bulge 1 at a lower portion thereof. Though bulge 1 is shown near one end of pillow 3 in FIG. 13, the present disclosure is not so limited, and the bulge 1 may be in any other location of pillow 3, or the bulge may be optional. Without wishing to be bound by theory, bulge 1 can provide neck support when positioned near an end of pillow 3, as illustrated. In some embodiments, the pillow may include one bulge, though multiple bulges may be provided.

Figure 13:
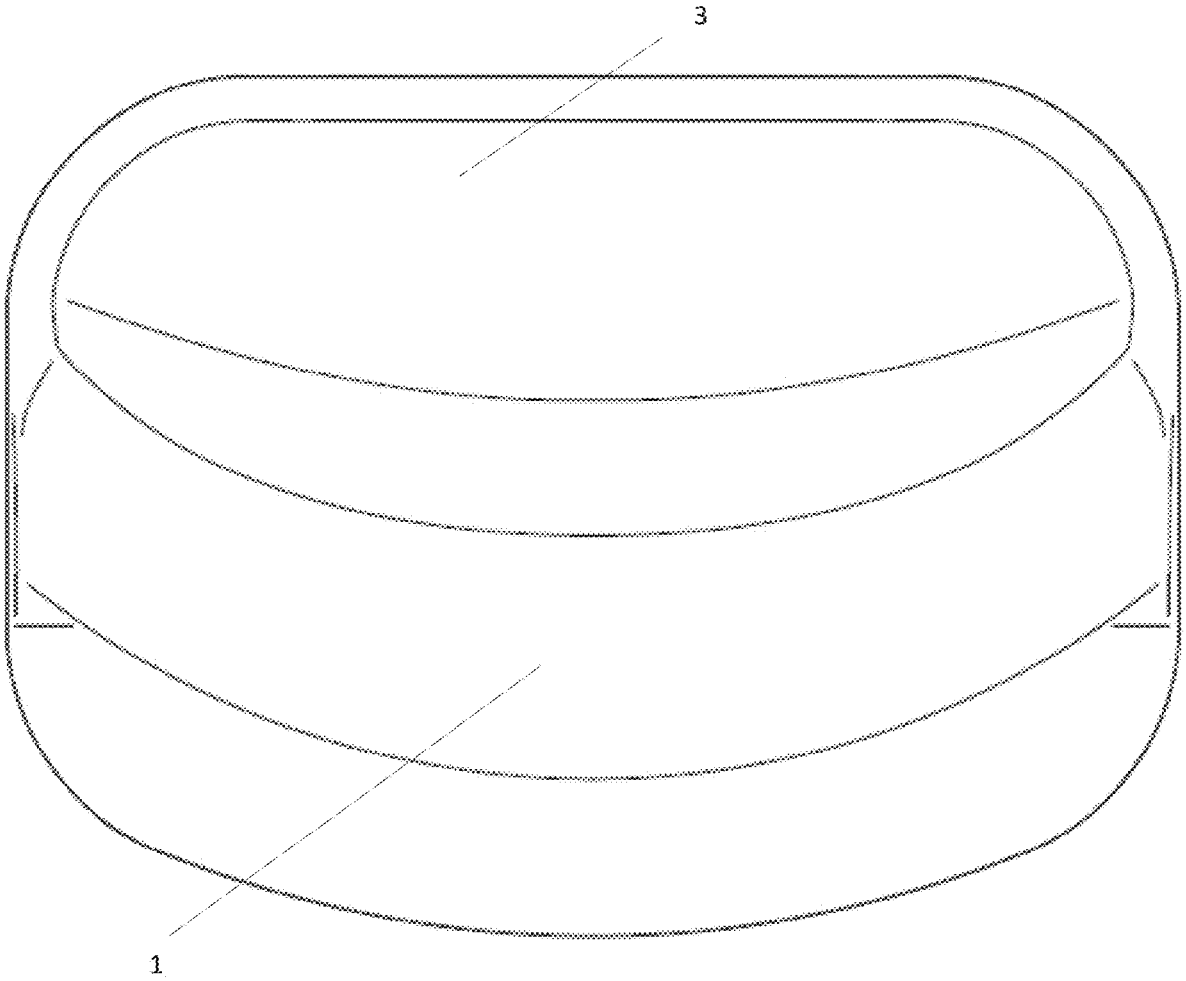
FIG. 13 is a front view of the pillow of FIG. 9.

Pillow 3 may be filled with gel, fiber, down, foam, or any other suitable filler. Pillow 3 may be made of synthetic fibers or any suitable fabric. Pillow 3 may be shaped as shown in FIG. 13, or pillow 3 may take a different shape. Pillow 3 may have different dimensions than those shown in FIG. 13.

The internal part of the clip assembly, e.g., bracket 8 shown in FIG. 11, may be placed in pillow 3 such that the filler of pillow 3 surrounds the internal part. In one embodiment, the filler, such as foam, may be overmolded onto the internal part to hold the internal part in place while also creating at least part of the filling of the pillow. Techniques for disposing the internal part in the pillow are not limited to overmolding techniques, and other suitable techniques may be employed.

Figure 14:
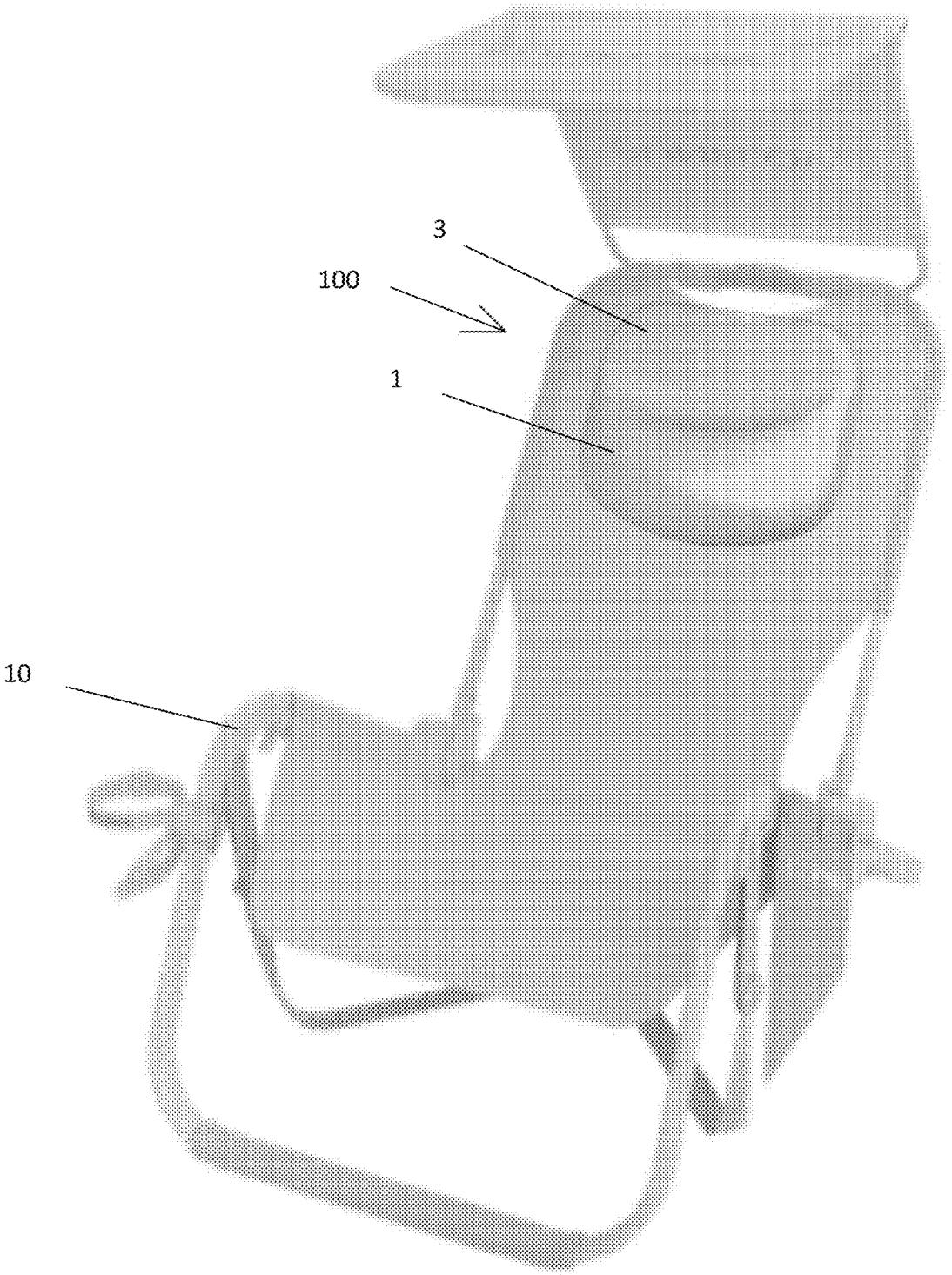
FIG. 14 shows a chair with the pillow assembly of FIG. 9 clipped to the back of the chair.

FIG. 14 shows a chair 10 with the pillow assembly 100. The pillow assembly 100 may be slid over a complementary part on a chair such that the pillow remains in place for secure use by a user. In one embodiment, the complementary part may include the top of the chair. Examples of a chair suitable for use with pillow assembly 100 are described in U.S. Pat. No. 10,631,651, in which a chair (e.g., chair 10) was introduced. U.S. Pat. No. 10,631,651 is hereby incorporated by reference in its entirety.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A pillow assembly, comprising:

a pillow; and a clip assembly coupled to the pillow, the clip assembly comprising:

a U-shaped clip that is disposed entirely outside the pillow and that is biased toward the pillow such that a restorative force of the clip is configured to secure the pillow to a chair; a bracket that is disposed entirely within the pillow, wherein an upper end of the bracket is rigidly fastened directly to an uppermost end of the U-shaped clip.

2. The pillow assembly of claim 1, wherein the clip comprises a grippy part disposed on a lower end of the clip.

3. The pillow assembly of claim 2, wherein the grippy part comprises serrated lines.

4. The pillow assembly of claim 1, wherein the clip comprises a tab protruding from a lower end of the clip.

5. The pillow assembly of claim 1, wherein the bracket is U-shaped.

6. The pillow assembly of claim 1, wherein the clip includes an outwardly formed bend.

7. The pillow assembly of claim 1, wherein the pillow comprises a bulge at a lower end of the pillow.

8. A pillow assembly, comprising:

a pillow; and a clip assembly coupled to the pillow, the clip assembly comprising:

a U-shaped clip that is disposed entirely outside the pillow and that is biased toward the pillow such that a restorative force of the clip is configured to secure the pillow to a chair, the U-shaped clip including an outwardly formed bend;

a grippy part disposed on a lower end of the U-shaped clip; and a tab protruding from the lower end of the U-shaped clip;

a bracket that is disposed entirely within the pillow, wherein an upper end of the bracket is rigidly fastened directly to an uppermost end of the U-shaped clip.

9. The pillow assembly of claim 8, wherein the grippy part comprises serrated lines.

10. The pillow assembly of claim 8, wherein the pillow comprises a bulge at a lower end of the pillow.

* * * * *